US010415885B2

(12) United States Patent
Pancher et al.

(10) Patent No.: US 10,415,885 B2
(45) Date of Patent: Sep. 17, 2019

(54) REFRACTORY BASED SIDEWALL MEMBER FOR PALLET CAR

(71) Applicant: Metso Minerals Industries, Inc., Waukesha, WI (US)

(72) Inventors: Jeffrey Mark Pancher, Coal Township, PA (US); Neil Raymond Dock, Selinsgrove, PA (US)

(73) Assignee: Metso Minerals Industries, Inc., Waukesha, WI (US)

( * ) Notice: Subject to any disclaimer, the term of this patent is extended or adjusted under 35 U.S.C. 154(b) by 0 days.

(21) Appl. No.: 15/145,038

(22) Filed: May 3, 2016

(65) Prior Publication Data

US 2017/0321963 A1 Nov. 9, 2017

(51) Int. Cl.

| | |
|---|---|
| ***F27D 3/12*** | (2006.01) |
| ***F27D 5/00*** | (2006.01) |
| ***C22B 1/20*** | (2006.01) |
| ***F27B 21/02*** | (2006.01) |
| ***F27B 21/06*** | (2006.01) |

(52) U.S. Cl.

CPC ..... *F27D 3/123* (2013.01); *C22B 1/20* (2013.01); *F27B 21/02* (2013.01); *F27B 21/06* (2013.01); *F27D 5/00* (2013.01); *F27D 3/12* (2013.01); *F27D 2003/122* (2013.01); *F27D 2003/125* (2013.01)

(58) Field of Classification Search

CPC ..... F27D 3/12; F27D 3/123; F27D 2003/125; F27D 2003/122; F27D 5/00; F27B 21/02; F27B 21/06; C22B 1/20

USPC ..... 432/241, 245, 246, 248, 252

See application file for complete search history.

(56) References Cited

U.S. PATENT DOCUMENTS

| | | | |
|---|---|---|---|
| 1,851,717 | A | 3/1929 | Meehan |
| 1,871,070 | A | 8/1932 | Meehan |
| 1,879,246 | A | 9/1932 | Hogue |
| 1,893,123 | A | 1/1933 | Beth |

(Continued)

FOREIGN PATENT DOCUMENTS

| | | | |
|---|---|---|---|
| DE | 4109396 | A1 | 9/1992 |
| GB | 748490 | A | 5/1956 |
| JP | H11 159968 | A | 6/1999 |

OTHER PUBLICATIONS

International Search Report and Written Opinion for International Patent Application No. PCT/US2017/028804 dated Jul. 20, 2017.

(Continued)

*Primary Examiner* — Steven B McAllister
*Assistant Examiner* — Benjamin W Johnson
(74) *Attorney, Agent, or Firm* — Andrus Intellectual Property Law, LLP

(57) ABSTRACT

A pallet car for conveying material to be processed is disclosed. The pallet car includes first and second sidewalls formed from sidewall members that each include a metal frame and a heat-resistant liner, such as formed from refractory. The refractory formed on the metal frame of the sidewall members provides insulation for the metal frame without the need for a hearth layer of pre-processed material in the material bed of the pallet car. The sidewall member including the refractory layer increases the effective volume of the pallet car, which increases the overall efficiency of the furnace and material processing procedure.

11 Claims, 5 Drawing Sheets

(56) References Cited

U.S. PATENT DOCUMENTS

| | | | | | |
|---|---|---|---|---|---|
| 2,322,873 | A | * | 6/1943 | Moriarty | F27B 21/06<br>266/279 |
| 2,985,440 | A | * | 5/1961 | Koontz | C22B 1/20<br>432/241 |
| 3,687,093 | A | * | 8/1972 | Byrd, Jr. | F27D 1/0009<br>110/343 |
| 3,824,071 | A | | 7/1974 | Lovold | |
| 4,247,000 | A | * | 1/1981 | Marriott, Jr. | C03B 29/08<br>198/780 |
| 4,289,485 | A | * | 9/1981 | Latowski | C22B 1/20<br>266/178 |
| 5,062,372 | A | * | 11/1991 | Ritter | F23G 5/08<br>110/235 |
| 5,938,434 | A | | 8/1999 | Groom | |
| 6,523,673 | B1 | | 2/2003 | Fenton | |
| 2015/0125800 | A1 | | 5/2015 | Schulakow-Klass | |

OTHER PUBLICATIONS

International Preliminary Report on Patentability for International Application No. PCT/US2017/028804 dated Nov. 15, 2018.

* cited by examiner

REFRACTORY BASED SIDEWALL MEMBER FOR PALLET CAR

BACKGROUND

The present disclosure generally relates to a pallet car for conveying material to be processed through a furnace. More specifically, the present disclosure relates to sidewall members for creating first and second sidewalls of a pallet car that each include a heat-resistant lining to eliminate the need for a hearth layer along the sidewalls.

Straight grate pallet cars are used to transport mineral material, such as iron ore pellets, through a furnace for sintering and oxidizing. The mineral material being processed is carried through the furnace on a series of aligned pallet cars. Each car has a mineral bed that contains the material being processed. FIG. 1 illustrates a pallet car 10 that represents the current state of the art. The pallet car 10 includes a pallet frame 12 that defines a generally horizontal support surface 14. The frame 12 includes a pair of end castings 16 that each support a series of rollers 18 that support the weight of the pallet car 10 during movement of the pallet car through the furnace.

The pallet car 10 includes a first sidewall 20 and a second sidewall 22 that extend along the entire length of the pallet car 10 to support a bed of mineral material 24 to be processed. In the prior art pallet car 10 shown in FIG. 1, both the first and second sidewalls 20, 22 are formed from a lower casting 26 and an upper casting 28. The upper and lower castings are both formed from metallic material and combine to form the first and second sidewalls 20, 22.

Since each of the sidewalls are formed from metal castings, the prior art pallet car 10 utilizes a hearth layer 30 of pre-processed material. The hearth layer 30 extends upward along both the first sidewall 20 and the second sidewall 22 as well as along the top surface of the grate bars 32 supported along the support surface 14 of the frame 12. The hearth layer 30 serves as a heat sink to protect the pallet car sidewall castings 26, 28 from the high temperatures required in the furnace for processing the mineral material 24 into usable product. In the embodiment shown in FIG. 1, the material that needs to be processed is shown by the green pellets 34 which are separated from the sidewall castings 26, 28 and the grate bars 32 by the hearth layer 30. As can be understood in FIG. 1, the total volume of material 24 that needs to be processed in the area shown by 34 is reduced due to the pre-processed material that forms the hearth layer 30. After the material 34 is processed, both the material 34 and the hearth layer 30 are removed from the pallet car 10 and a new hearth layer 30 is created. Thus, the use of the hearth layer 30 reduces the operating efficiency of the furnace due to the re-processing of the material that is required to form the hearth layer 30.

SUMMARY

The present disclosure generally relates to a pallet car that is used to convey mineral material, such as iron ore, through a furnace for processing within the furnace.

The pallet car includes a base that defines a horizontal support surface for receiving the mineral material to be processed. The base includes a plurality of rollers that allows the pallet car to move through the furnace during processing of the mineral material. A plurality of grate bars is supported on the support surface of the base to insulate the base while the base is within the furnace.

The pallet car includes both first and second sidewalls that are formed on opposite sides of the base. The first and second sidewalls, in combination with the grate bars, define a product bed for receiving the mineral material being processed. In accordance with the present disclosure, each of the first and second sidewalls is formed from a plurality of sidewall members that are aligned in an end-to-end relationship to define the first and second sidewalls. The plurality of sidewall members each include a metal frame and a heat-resistant liner that is attached to an inner surface of the metal frame. Since the plurality of sidewall members defines the first and second sidewalls, each of the sidewall members is in contact with the mineral material during processing within the furnace. The heat-resistant liner formed on the inner surface of the metal frame provides heat insulation for the metal frame, thereby eliminating the need for a hearth layer along the sidewalls as was required in prior art systems.

In one embodiment of the disclosure, the heat-resistant liner is formed from a refractory material that is molded onto the metal frame. The molding process for attaching the heat-resistant liner onto the metal frame allows the sidewall member to be formed and later installed as a single piece. In one embodiment of the disclosure, the inner surface of the metal frame includes a plurality of anchors that act to hold the refractory along the inner surface of the metal frame. The plurality of anchors can have various different shapes and configurations and are positioned on the metal frame prior to molding the refractory material onto the metal frame.

In one embodiment of the disclosure, a retainer is positioned between each of the sidewall members and the plurality of grate bars. The retainer is connected to the sidewall member and provides lateral support for the grate bars. The retainer includes a metallic backing frame and a heat-resistant liner. The heat-resistant liner is exposed to the material during processing and provides thermal insulation for the metallic backing frame. In one embodiment of the disclosure, the heat-resistant liner is formed from the same refractory material as used on each of the sidewall members.

In accordance with the present disclosure, individual sidewall members can be created and installed on pre-existing pallet cars. In such an embodiment, the sidewall members would replace prior art sidewall members and allow pre-existing pallet cars to be reconfigured and used without the need for the hearth layer along the sidewalls. In such an embodiment, the sidewall members would each include a metal frame and a heat-resistant liner attached to the inner surface of the metal frame.

Various other features, objects and advantages of the invention will be made apparent from the following description taken together with the drawings.

BRIEF DESCRIPTION OF THE DRAWINGS

The drawings illustrate the best mode presently contemplated of carrying out the disclosure. In the drawings.

DETAILED DESCRIPTION

Figure 1:
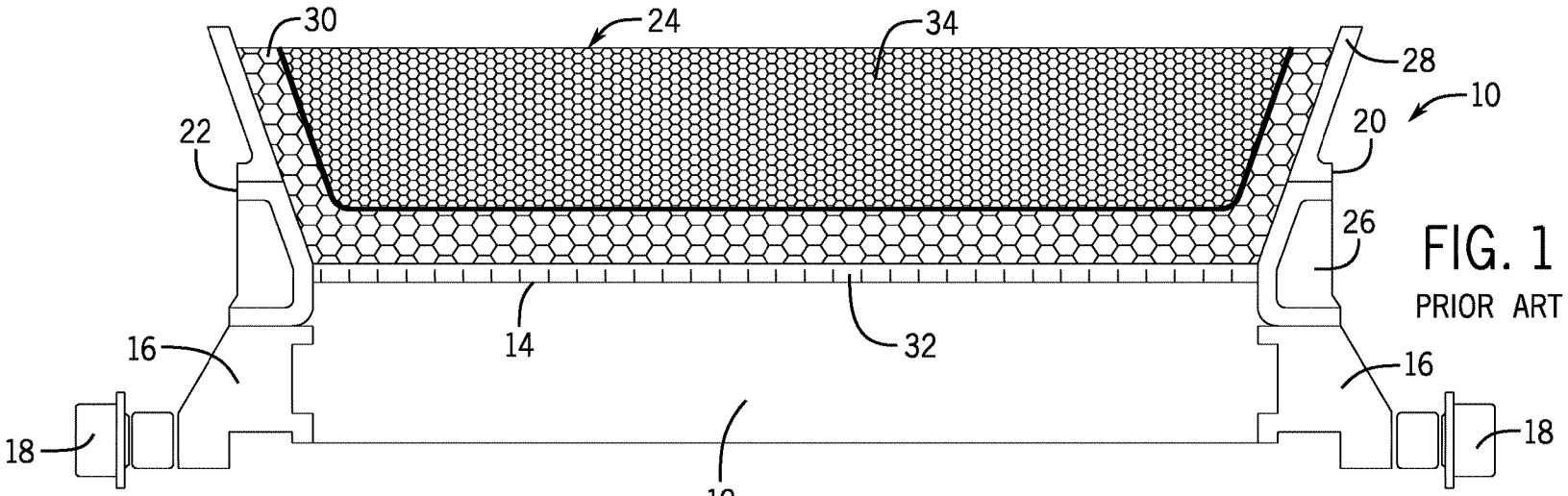
FIG. 1 PRIOR ART
FIG. 1 is an end view of a prior art pallet car.

FIG. 1 illustrates a pallet car 40 constructed in accordance with the present disclosure. Much like the prior art pallet car 10 shown in FIG. 1, the pallet car 40 is used to transport mineral material, such as iron ore pellets, through a furnace for sintering and oxidizing. The pallet car 40 includes a base 42 that includes a central casting 44 that defines an upper support surface 46. In the embodiment shown in FIG. 2, the upper support surface 46 is generally horizontal and provides support for a series of individual grate bars 32. The grate bars 32 are each formed from a heat-resistant material and provide thermal protection for the top surface 46 of the central casting 44. Each of the individual grate bars 32 can be more clearly seen in the section view of FIG. 3.

Figure 2:
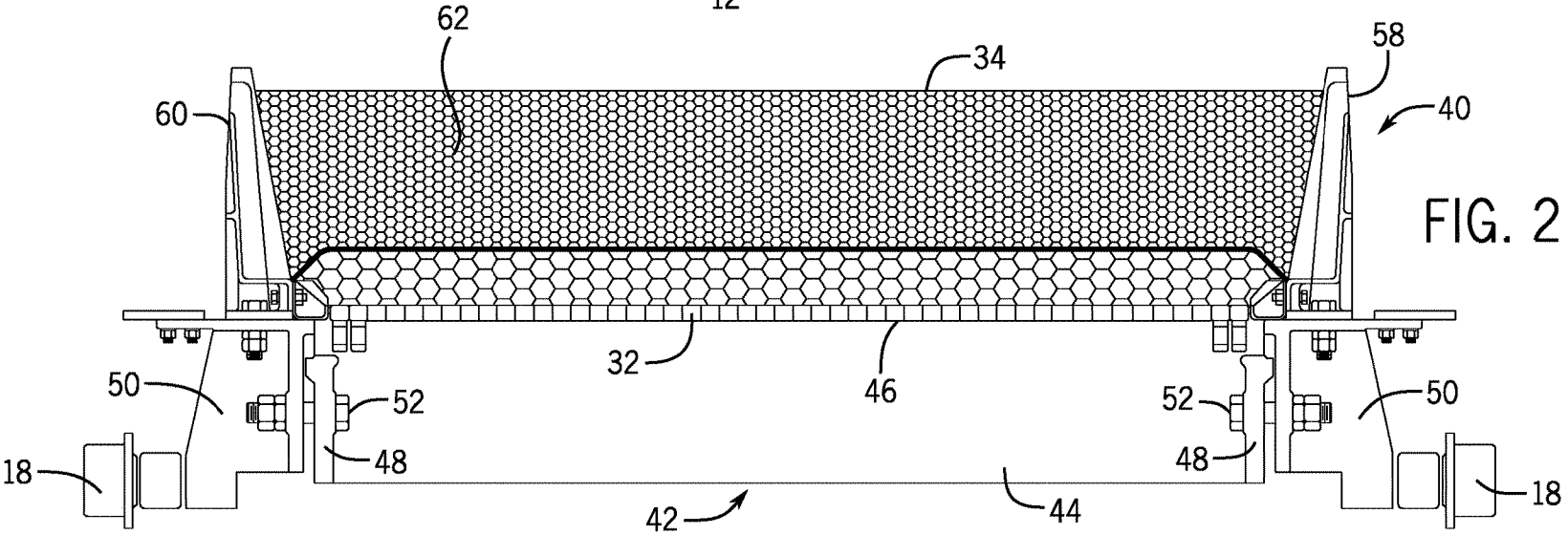
FIG. 2 is an end view of a pallet car utilizing the sidewall members of the present disclosure.
Figure 3:
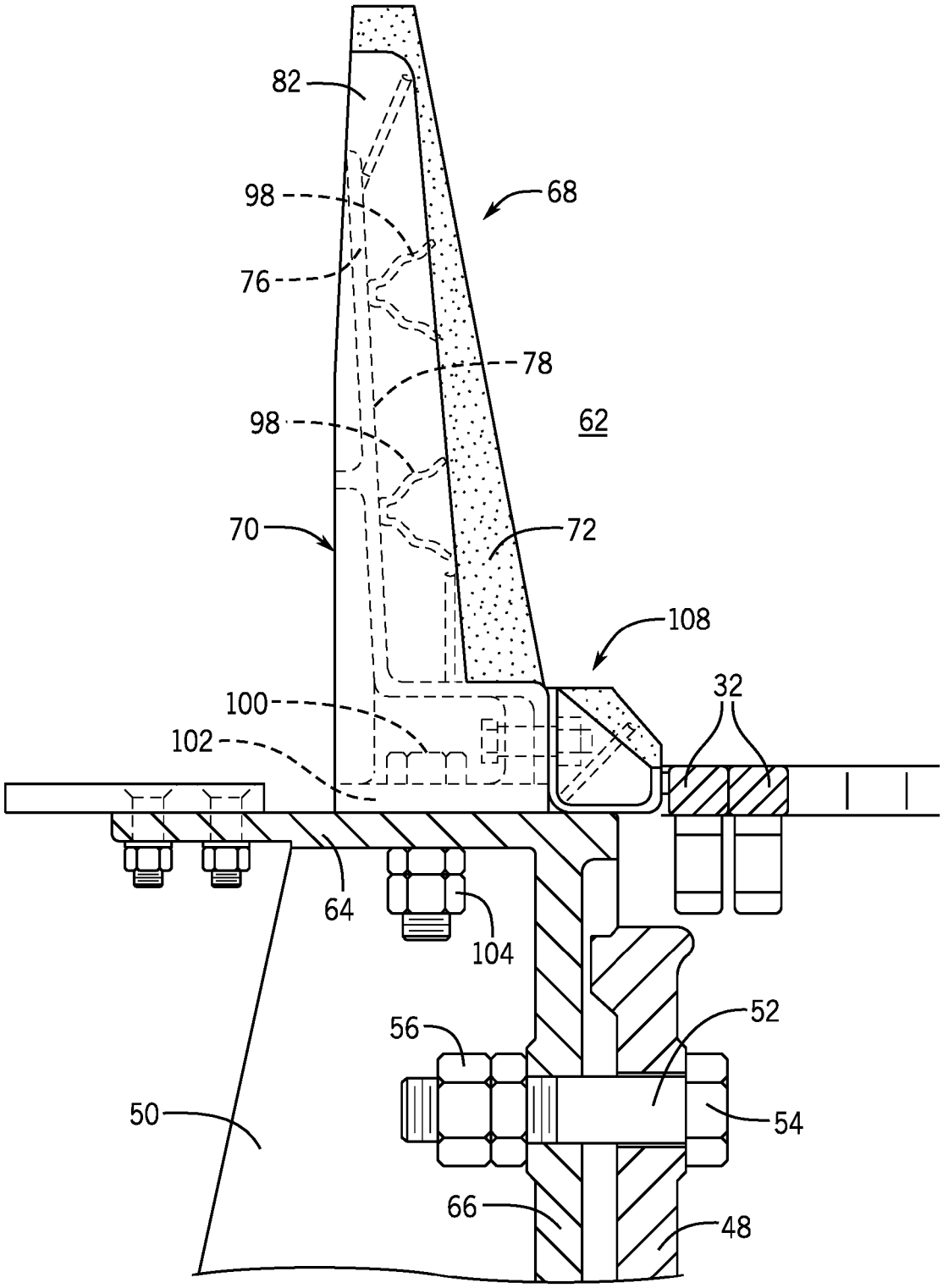
FIG. 3 is a magnified end view showing one of the sidewall members mounted to the pallet car.

As illustrated in FIGS. 2 and 3, the central casting 44 includes a pair of spaced end walls 48 that are each connected to one of the end casting 50. The end casting 50 is connected to the end wall 48 by a series of bolts 52. The bolts 52 each include a head 54 and a nut 56 to removably connect the end casting 50 to the central casting 44. As illustrated in FIG. 2, each of the end castings 50 supports a series of rollers 18 that allow the individual pallet car 40 to roll through a furnace in a known manner.

As illustrated in FIG. 2, the pallet car 40 includes a first sidewall 58 and a second sidewall 60 located on opposite sides of the central casting 44. Each of the two sidewalls 58, 60 extends vertically above the series of grate bars 32 and defines a product bed 62. The product bed 62 receives a supply of material 34 to be processed by the furnace. As can be understood in the comparison of FIGS. 1 and 2, the hearth layer 30 is present only along the top of the grate bars 32. Thus, the volume of material 34 that can be received within the material bed 62 in the embodiment of FIG. 2 is larger than the volume of material in the prior art pallet car 10 shown in FIG. 1. This increase in volume is due to the elimination of the hearth layer 30 along the sidewalls as required by the prior art embodiment of FIG. 1. The elimination of the hearth layer 30 along the sidewalls is possible due to the configuration of the first and second sidewalls 58, 60, as will be described in greater detail below.

Figure 4:
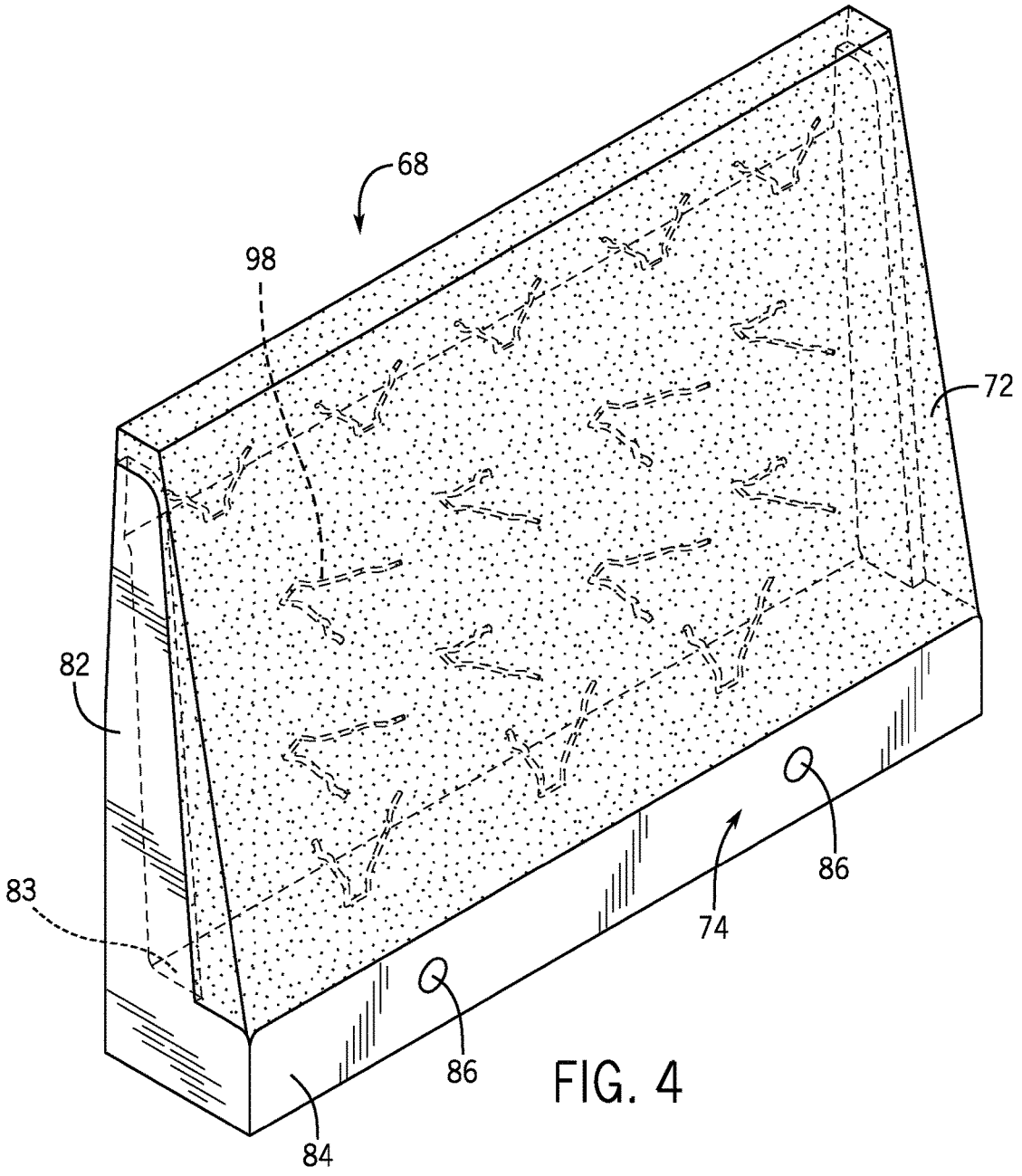
FIG. 4 is a perspective view illustrating one of the sidewall members.

Referring now to FIG. 3, each of the end castings 50 includes a generally horizontal support plate 64 that extends from the vertical end wall 66. The vertical end wall 66 is used to attach the end casting 50 to the end wall 48 of the central casting through the series of bolts 52. The support plate 64 provides for a point of connection for each of the sidewall members 68 that combine to form both the first sidewall 58 and the second sidewall 60. FIG. 4 is a perspective view of one of the sidewall members 68. It should be understood that a plurality of the individual sidewall members 68 are positioned in an end-to-end relationship to define both the first sidewall 58 and the second sidewall 60.

Figure 5:
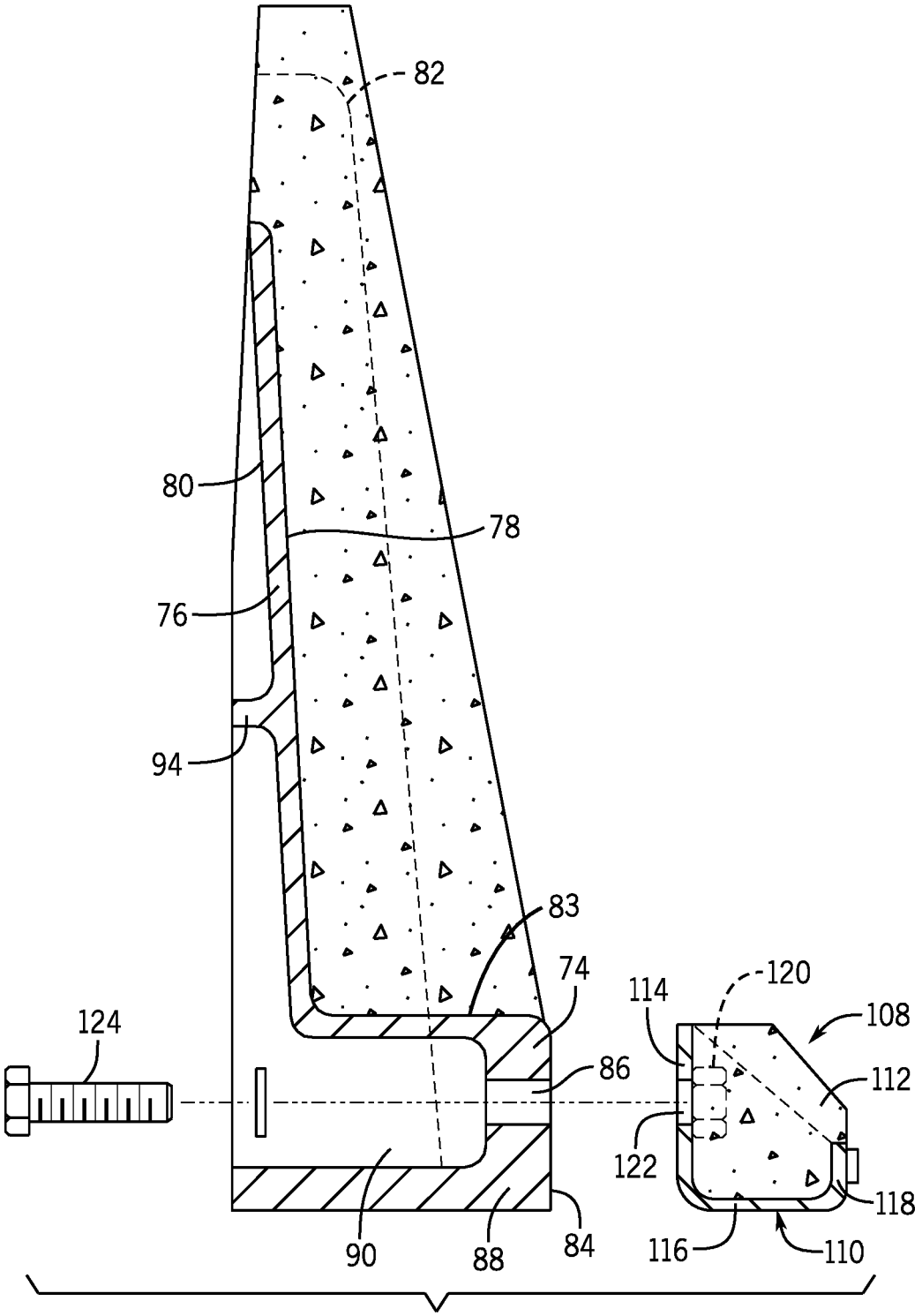
FIG. 5 is a section view of the sidewall member and retainer.

As shown in FIGS. 3 and 5, the individual sidewall members 68 each include a metal frame 70 and a heat-resistant liner 72 securely attached to and supported by the metal frame 70. As can be seen in FIGS. 4 and 5, the metal frame 70 includes a lower, mounting portion 74 and a support wall 76. Support wall 76 is a generally plate-like member that includes an inner surface 78 and an outer surface 80 that are separated by the thickness of the support wall 76. As can be understood in FIGS. 4 and 7, the support wall 76 extends between a pair of spaced side flanges 82 that define the overall length of the sidewall member 68. Each of the side flanges 82 extends inwardly from the support wall 76. Each of the side flanges 82 also define the ends of the mounting portion 74 of the sidewall member 68. As best shown in FIG. 4, the mounting portion includes a top surface 83 and a front face surface 84 that includes a pair of spaced mounting holes 86. As illustrated in FIG. 5, each of the mounting holes 86 extends through the front wall 88 from the front face surface 84 and into a receiving cavity 90. As can be seen in the back view of FIG. 7, each of the mounting holes 86 is contained within the cavity 90, which is in turn defined by a pair of vertical support webs 92.

Figure 7:
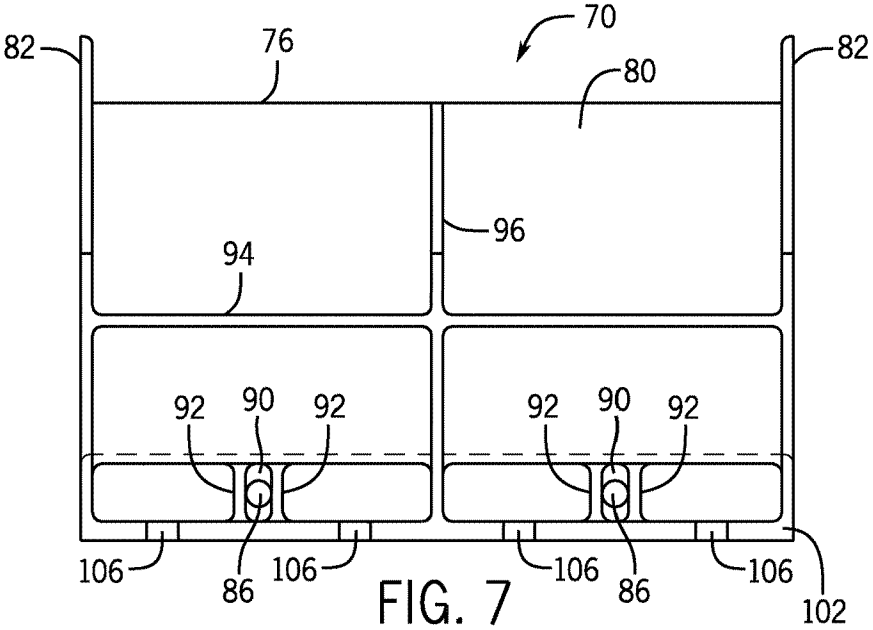
FIG. 7 is a back view of one of the sidewall members.
Figure 6:
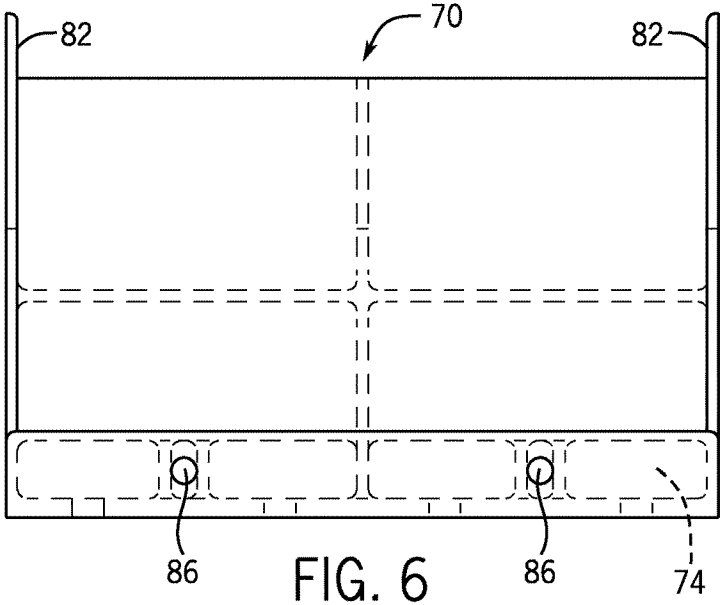
FIG. 6 is a front view of one of the sidewall members.

As can further be seen in FIG. 7, the back surface 80 of the support wall 76 includes a horizontal web 94 and a vertical web 96 that provide additional strength and stability for the support wall 76.

Referring now to FIG. 3, in one embodiment of the disclosure, the support wall 76 includes a plurality of anchors 98 attached to the front surface 78 of the support wall 76 or the top face 83 of the lower, mounting portion 74. Each of the anchors 98 extends away from the inner surface 78 or the top face 83 and provides a point of attachment for the heat-resistant liner 72. In the preferred embodiment of the disclosure shown in the drawing figures, the heat-resistant liner 72 is formed from a refractory material that is molded onto the metal frame 70. The anchors 98 provide a durable method of attaching the molded refractory material to the metal frame 70 such that the refractory material does not separate from the metal frame 70 during use. Alternatively, it is contemplated that the heat-resistant liner 72 could be attached to the metal frame 70 utilizing other connection methods, such as bolts or some other type of attachment mechanism. In such an embodiment, the heat-resistant liner 72 would be a separate component that can be physically connected to the metal frame 70.

As can be understood in FIG. 3, each of the sidewall members 68 is securely attached to the support plate 64 of the end casting 50 by a plurality of bolts 100. Each bolt 100 extends through a bottom wall 102 of the metal frame 70 and through an aligned opening formed in the support plate 64 of the end casting 50. One or more nuts 104 are used to removably secure each of the individual sidewall members 68 in the manner illustrated. The mounting holes used to receive the bolt 100 are shown by reference numeral 106 in FIG. 7. Although this type of mounting arrangement is shown in the drawing figures to secure each individual sidewall member 68 to the frame of the pallet car, other forms of attachment are contemplated as being within the scope of the present disclosure.

Referring now to FIGS. 3 and 5, a retainer 108 is used to lock the grate bars 32 in place between the first and second sidewalls. The retainer 108 includes a metal backing frame 110 and a heat-resistant liner 112. In the embodiment shown in FIG. 4, the backing frame 110 includes a back wall 114, a bottom wall 116 and a front lip 118. The combination of the back wall 114, bottom wall 116 and front lip 118 define a receiving cavity that holds the heat-resistant material that forms the liner 112. In the embodiment shown, the heat-resistant material that forms the liner 112 is also a refractory material. The refractory material provides heat-resistant insulation for the metal material that forms the backing frame 110.

The refractory material that forms the heat-resistant liner 112 surrounds a series of spaced nuts 120 that are lined with access openings 122. The openings 122 are generally aligned with the mounting holes 86 such that a bolt can extend through the mounting holes 86 and openings 122 and be received within the internally threaded nut 120. In this manner, the retainer 108 can be securely attached to the front face surface 84 and securely positioned between the sidewall member 68 and the individual grate bars 32, as best shown in FIG. 3.

Although the embodiment shown in the drawing figures includes a specific attachment method for each of the sidewall members to the frame of the pallet car, different mounting arrangements are contemplated as being within the scope of the present disclosure. Additionally, the retainer 108 shown in the drawing figures could be eliminated in alternate embodiments. However, in accordance with the present disclosure, each of the sidewall members is created utilizing a metal frame and a heat-resistant liner, such as a liner formed from refractory. The heat-resistant liner formed integrally with the metal frame provides heat resistant insulation which can eliminate the need for a hearth layer. Although a hearth layer could also be utilized with the sidewalls constructed in accordance with the present disclosure, it is believed that such a hearth layer would not be required while operating within the scope of the present disclosure.

As discussed above, the heat-resistant liner protects both the metal support frame 70 of the sidewall member 68 and the metal backing frame 110 of the retainer 108. The use of the heat resistant liner allows the sidewalls of the pallet car to provide the required thermal insulation for the metal frames and eliminates the need for the hearth layer as in the prior art embodiment of FIG. 1.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

We claim:

1. A sidewall member for use with a pallet ca r for conveying material to be processed through a furnace, the sidewall member comprising:

a metal frame including a lower mounting portion;

a support wall extending from the lower mounting portion that has a front surface;

a plurality of anchors extending from and attached to the front surface of the support wall and a top surface of the lower mounting portion; and a heat-resistant liner that is supported on the top surface of the lower mounting portion and formed integrally with the metal frame, wherein the heat-resistant liner is formed from a refractory material that is molded to surround and completely envelop the plurality of anchors such that the heat-resistant liner completely conceals the plurality of anchors and prevents contact between material to be processed and the anchors.

2. The sidewall member of claim 1 further comprising a retainer coupled to the sidewall member to position the sidewall member on the pallet car.

3. The sidewall member of claim 2 wherein the retainer includes a metallic backing frame and a heat-resistant liner.

4. The sidewall member of claim 3 wherein the heat resistant liner of the retainer is made of a refractory material.

5. A pallet car for conveying material to be processed through a furnace, comprising:

a base having a horizontal support surface and a plurality of rollers;

a plurality of grate bars supported on the support surface for receiving the material; and a plurality of sidewall members aligned to form a first sidewall on a first side of the base and a second sidewall on a second side of the base, wherein each of the sidewall members comprises:

a metal frame including a lower mounting portion;

a support wall extending from the lower mounting portion that has a front surface;

a plurality of anchors extending from and attached to the front surface of the support wall and a top surface of the lower mounting portion; and a heat-resistant liner that is supported on the top surface of the lower mounting portion and formed integrally with the metal frame, wherein the heat-resistant liner is formed from a refractory material that is molded to surround and completely envelop the plurality of anchors such that the heat-resistant liner completely conceals the plurality of anchors and prevents contact between material to be processed and the anchors.

6. The pallet car of claim 5 wherein the plurality of sidewall members are connected to the base of the pallet car.

7. The pallet car of claim 5 further comprising a plurality of retainers each positioned between one of the sidewall members and the plurality of grate bars.

8. The pallet car of claim 7 wherein the plurality of retainers each include a metallic backing frame and a heat-resistant liner, wherein the metallic backing frame is connected to the metal frame of one of the plurality sidewall members.

9. The pallet car of claim 8 wherein the heat-resistant liner of each of the plurality of retainers is formed from a refractory material.

10. A pallet car for conveying material to be processed through a furnace, comprising:

a base having a horizontal support surface and a plurality of rollers;

a plurality of grate bars supported on the support surface of the base for receiving the material;

a plurality of sidewall members aligned to form a first sidewall on a first side of the base and a second sidewall on a second side of the base, wherein each of the sidewall members comprises:

a metal frame including a lower mounting portion;

a support wall extending from the lower mounting portion that has a front surface;

a plurality of anchors extending from and attached to the front surface of the support wall and a top surface of the lower mounting portion; and a heat-resistant liner that is supported on the top surface of the lower mounting portion and formed integrally with the metal frame, wherein the heat-resistant liner is formed from a refractory material that is molded to surround and completely envelop the plurality of anchors such that the heat-resistant liner completely conceals the plurality of anchors and prevents contact between material to be processed and the anchors; and wherein the pallet car further comprises:

a plurality of retainers each positioned between one of the sidewall members and the plurality of grate bars, each retainer including a metallic backing frame, at least one nut and a refractory lining that is molded to completely surround the at least one nut, wherein at least one bolt extends through the metallic backing frame of each of the plurality of retainers and is received in the at least one nut to attach the retainer to a respective sidewall member.

11. The pallet car of claim 10 wherein the plurality of grate bars and the plurality of sidewall members define a product bed to receive material to be processed.

* * * * *